US009022829B2

(12) United States Patent
Rosen et al.

(10) Patent No.: US 9,022,829 B2
(45) Date of Patent: May 5, 2015

(54) MAGNETIC MODULE AND CONSTRUCTION KIT

(71) Applicant: LaRose Industries, LLC, Randolph, NJ (US)

(72) Inventors: Lawrence Rosen, Mendham, NJ (US); Parviz Daftari, Summit, NJ (US)

(73) Assignee: LaRose Industries, LLC, Randolph, NJ (US)

( * ) Notice: Subject to any disclaimer, the term of this patent is extended or adjusted under 35 U.S.C. 154(b) by 0 days.

(21) Appl. No.: 13/740,654

(22) Filed: Jan. 14, 2013

(65) Prior Publication Data

US 2013/0267145 A1 Oct. 10, 2013

Related U.S. Application Data

(60) Provisional application No. 61/586,351, filed on Jan. 13, 2012.

(51) Int. Cl.

| | |
|---|---|
| ***A63H 33/08*** | (2006.01) |
| ***A63H 33/04*** | (2006.01) |
| *A63H 33/00* | (2006.01) |

(52) U.S. Cl.

CPC ..... *A63H 33/046* (2013.01)

(58) Field of Classification Search

CPC ..... A63H 33/00; A63H 33/08; A63H 33/26; A63H 33/046; A44D 2203/00

USPC ..... 446/85, 92, 129, 131, 137, 138, 139

See application file for complete search history.

(56) References Cited

U.S. PATENT DOCUMENTS

| | | | | |
|---|---|---|---|---|
| 6,749,780 | B2 * | 6/2004 | Tobias | 264/37.31 |
| 7,154,363 | B2 * | 12/2006 | Hunts | 335/306 |
| 7,160,170 | B2 * | 1/2007 | Yoon | 446/92 |
| 8,458,863 | B2 * | 6/2013 | Hunts | 24/303 |
| 2010/0120322 | A1 * | 5/2010 | Vicentelli | 446/92 |

* cited by examiner

*Primary Examiner* — Kien Nguyen

(74) *Attorney, Agent, or Firm* — Greenberg Traurig, LLP

(57) ABSTRACT

A toy construction kit has a plurality of magnetic modules, each with a housing having a plurality of sides, each side having an internal hollow. A magnet is contained within each of the hollows at a given polar orientation relative to the housing and the hollow. The hollow has dimensions that permit the magnet to move within the hollow, but substantially constrains the magnet to the given polar orientation relative to the housing. When a side of a module is placed near a side of another module, they are bound by magnetic attraction by the respective aligned magnets, either because the polar orientations are opposite when they are initially juxtaposed or due to shifting of one or both magnets in their respective hollows to achieve relative polar opposition.

13 Claims, 4 Drawing Sheets

MAGNETIC MODULE AND CONSTRUCTION KIT

CROSS-REFERENCE TO RELATED APPLICATION

This application is a Section 111(a) application relating to and claiming the benefit of commonly owned, co-pending U.S. Provisional Patent Application Ser. No. 61/586,351 entitled "MAGNETIC MODULE AND CONSTRUCTION KIT", filed Jan. 13, 2013, the entirety of which is incorporated herein by reference

FIELD OF THE INVENTION

The present invention relates to a magnetic device and, and more particularly, to a magnetic module that may be used with other like modules in a toy construction kit for building structures.

BACKGROUND

Various types of magnetic devices and construction kits, including those using magnetic elements are known. Notwithstanding, variations and improvements in known magnetic devices and construction kits and methods for making them are desirable.

SUMMARY

The disclosed subject matter relates to a magnetic module with a housing having an internal hollow. A magnet is contained within the hollow at a given polar orientation relative to the housing and the hollow. The hollow has dimensions that permit the magnet to move axially within the hollow, but substantially constrains the magnet to the given polar orientation relative to the housing.

BRIEF DESCRIPTION OF THE DRAWINGS

For a more complete understanding of the present invention, reference is made to the following detailed description of exemplary embodiments considered in conjunction with the accompanying drawings.

DETAILED DESCRIPTION OF EXEMPLARY EMBODIMENTS

Figure 2:
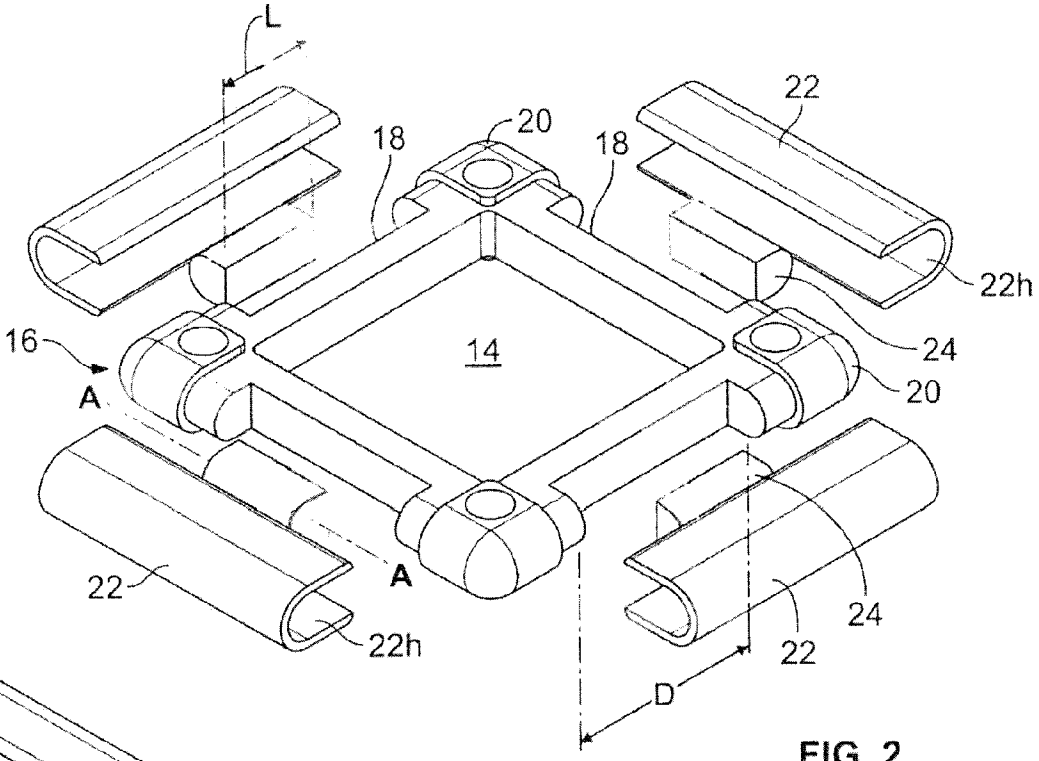
FIG. 2 is an exploded view of the module of FIG. 1.
Figure 1:
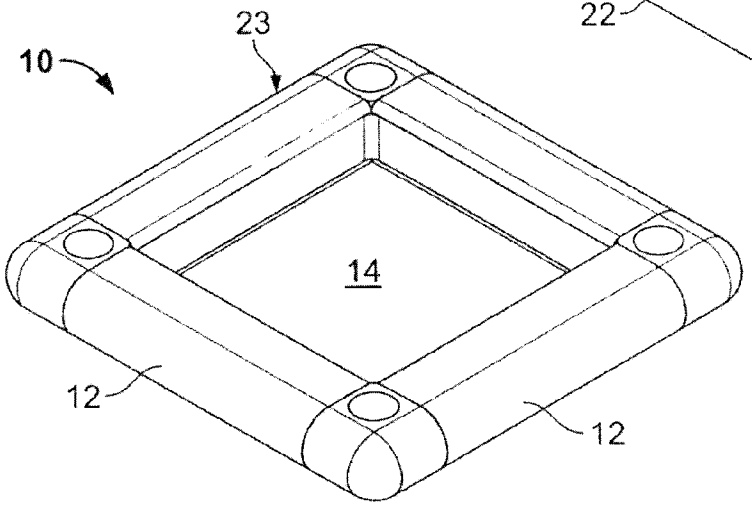
FIG. 1 is a magnetic module in accordance with an embodiment of the present disclosure.

FIGS. 1 and 2 show a module 10 in accordance with an embodiment of the present disclosure. The module 10 in FIG. 1 is generally rectangular having four sides 12 disposed about an internal space 14. Alternatively, the module could have any shape including alternative geometric shapes, such as triangular, pentagonal, hexagonal, trapezoidal, etc. In addition, the space 14 could be filled with a panel, e.g., which displays decorative or meaningful indicia. FIG. 2 shows that the module 10 has an internal framework 16 with webs 18 extending between corner pieces 20. Caps 22 clip to framework 16, e.g., via mating prominences and recesses (not shown) and plastic deformation and recovery of the caps 22, defining a hollow 22*h*. When clipped to the framework 16, the caps 22 capture magnets 24 therebetween. The caps 22 and framework 18 could be said to define a housing 23. As shown in FIG. 2, the magnets 24 may have a cross-sectional shape (D-shape), which approximates the internal shape of the corresponding cap 22 such that the cap 22 closely embraces the magnet 24 preventing rotation of the magnet 24 along a longitudinal axis A thereof. The length L of the magnet 24 may be selected to be shorter than the distance D between the corner pieces 20, providing space for the magnet 24 to slide longitudinally between the corner pieces over a range of movement when retained by the caps 22. The D-shape of the magnets 24 illustrates that the magnets need not rotate relative to the housing in order to assume a position enabling magnetic attraction. Due to the polarization on the magnets 24 in the axial direction, their interaction (either attraction or repulsion) when brought into proximity would result in axial movement, e.g. along an axis line like line A in FIG. 1, within the caps 22. The magnets would not rotate about the axis A under the influence of other magnets 24, hence a non-rotatable configuration for the magnets 24 relative to the housing 23, like the D shape, would not hamper a linearly sliding reaction. As an alternative to the D-shaped cross section, the magnets 24 may be formed in a any cross-sectional shape, such as cylindrical, rectangular, hexagonal, etc., that allows them to slide in an axial direction within a mating hollow 22*h* in the housing 23. The hollow 22*h* need not conform exactly to the exterior configuration of the magnets 24, but may function as a guide, e.g., having guide ribs or vanes that contact the magnets 24, rather than having a complementary internal shape. As can be appreciated by one of normal skill in the art, a housing 23 having hollows 22*h* to slideably accommodate magnets 24 therein may be formed by alternative constructs that do not require caps 22. For example, the housing can be made in as a pair of mating halves with internal tracks for the magnets 24, such that when the halves are conjoined, the magnets 24 are contained therein.

Figure 3:
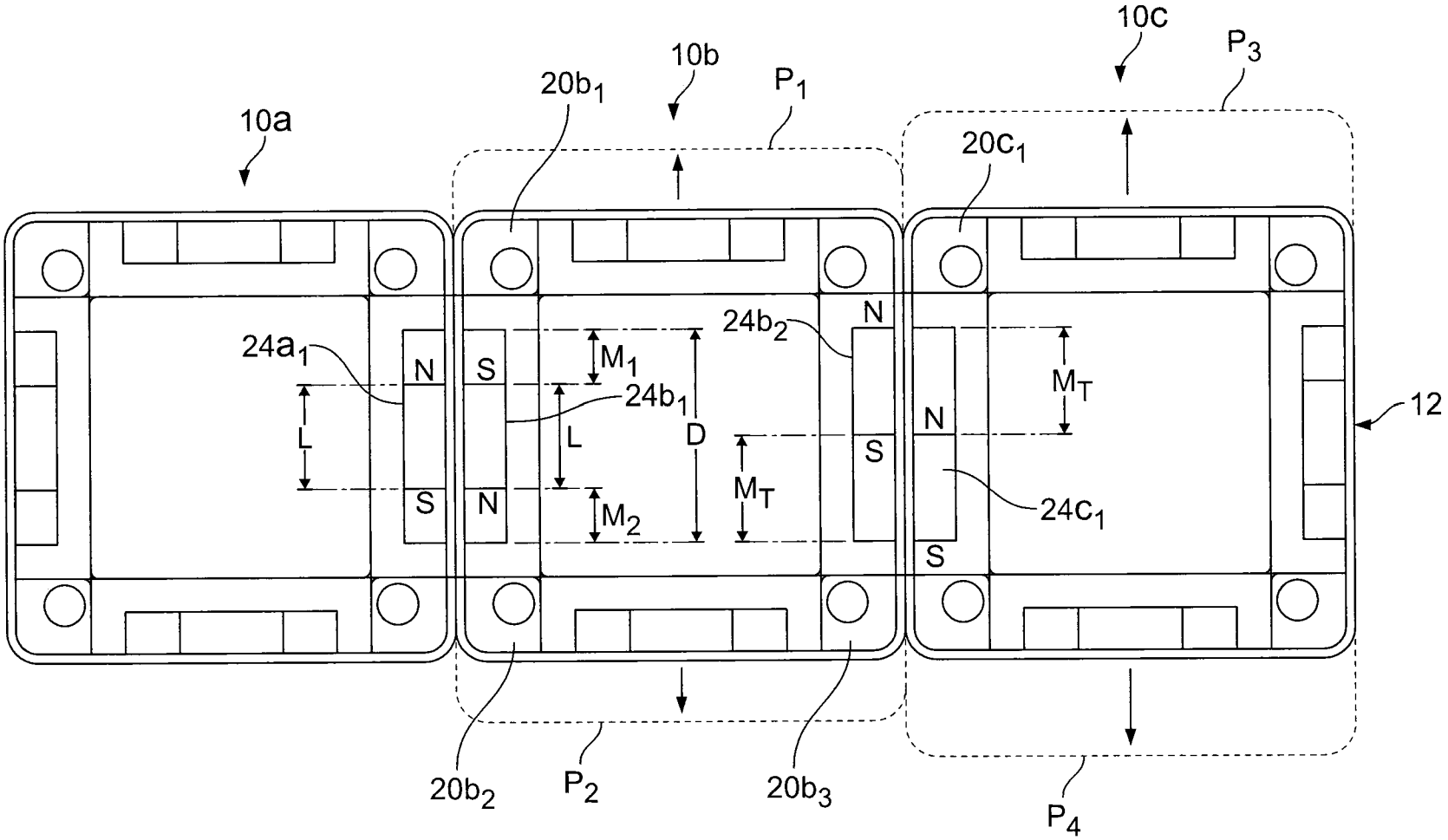
FIG. 3 is a diagrammatic view of a plurality of modules like the module of FIG. 1, positioned side-by-side.

FIG. 3 shows three modules 10*a*, 10*b*, 10*c* positioned next to one another with adjacent magnets 24*a*1, 24*b*1, 24*b*2 and 24*c*1 thereof, interacting. Opposite poles of magnets attract and like poles repel. Adjacent, side-by-side magnets 24*a*1 and 24*b*1 are positioned to attract one another because their respective North (N) South (S) polarity is opposite. As noted above, the magnets, e.g., 24*b*1 may be dimensioned with a length L that is less than the distance D between adjacent corner pieces, e.g., 20*b*1 and 20*b*2 of module 10*b*. As a result, there is a range of movement for the magnet 24*b*1 a distance M1 (in the upward direction, as shown in FIG. 3) and a distance M2 (downwardly), which together represent the total magnitude Mt of the range of motion. As shown by the dotted position lines P1 and P2, distances M1 and M2 permit the modules 10*a* and 10*b* to be shifted relative to each other by a like distance—up and down, and still remain associated by the attraction of the magnets 24*a*1 and 24*b*1.

In the event that the modules, e.g., 10*b*, 10*c*, are oriented with adjacent magnets 24*b*2 , 24*c*1 having the same North-South orientation (as shown at the conjunction of 10*b* and 10*c*, with both North poles up and both South poles down), the magnets 24*b*2 , 24*c*1 may slide within the respective cap 22 (not shown) to permit like poles to distance themselves and dissimilar poles to align. Magnet 24*b*2 has slid the distance Mt from the corner piece 20*b*3 in the upward direction and magnet 24*c*1 has slid down a distance Mt away from corner piece 20*c*1 to allow the South pole (S) of magnet 24*b*2 to be aligned with the North pole (N) of magnet 24*c*1. As shown by the dotted position lines P3 and P4, the modules 10*b* and 10*c* can remain coupled by with the same degree of magnetic attraction from the position shown in solid lines to the position shown in dotted lines indicated by P4. If the module 10*c* is moved to position P3, the magnets 24*b*2 and 24*c*1 would have to shift positions, i.e., all the way to the bottom for 24*b*2 and all the way to the top for magnet 24*c*1, in order to remain coupled by the same degree of attraction. The foregoing movable retention of the magnets 24 provides assembly variability over that of a configuration wherein the magnets are at a fixed position along the length of a side 12 and permits different relative arrangements of modules 10 and different structures 50 (FIG. 5) to be made from the modules.

Figure 4:
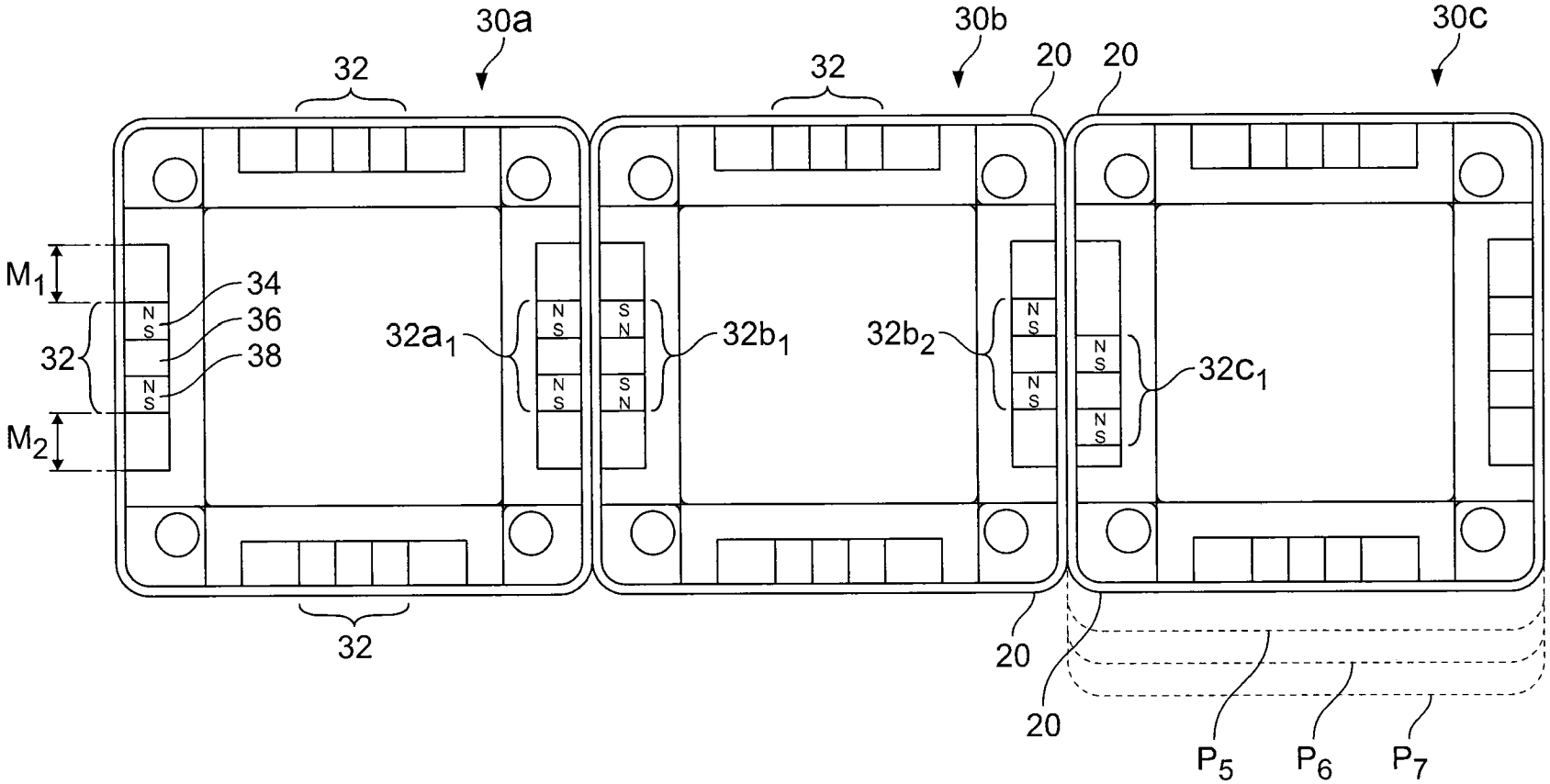
FIG. 4 is a diagrammatic view of a plurality of modules in accordance with an alternative embodiment of the present disclosure positioned side-by-side.

FIG. 4 shows three modules 30*a*, 30*b*, 30*c* positioned next to one another, each having magnet stacks 32 having a plurality of magnets (two magnets 34, 38 with an intervening non-ferrous, non-magnetic spacer 36 therebetween, but any number of magnets and intervening spacers may be used). The spacer 36 may be made from a polymer, such as nylon or similar materials and attached to the magnets 34, 38 by mechanical/frictional engagement, e.g., the magnets may slide within a tight-fitting, complementary-shaped recess in either end of the spacer 36, by plastic welding, injection molding around the magnets 34, 38, or adhesive attachment. The magnet stacks 32 of adjacent modules 30 interact to couple the modules, e.g., 30*a* and 30*b*, by magnetic attraction. As in prior embodiments, the magnet stacks 32 may be non-rotatable on a longitudinal axis, e.g., because they are formed in a complementary, non-rotatable shape relative to the caps 22 (FIG. 1). Alternatively, the magnet stacks 32 may have a cylindrical, rectangular, square or other cross-sectional shape. In any case, the magnet stacks 32 would be confined to slide in a substantially axial direction within a mating hollow housing 23.

The stacks 32*a*1 and 32*b*1 are oriented with reverse polarity when positioned immediately adjacent one another and therefore exert a relative magnetic attraction in this position. Stacks 32*b*2 and 32*c*1 have the same polar orientation such that like poles would be adjacent one another if positioned directly adjacent, like 32*a*1 and 32*b*1. Because the magnet stacks 32*b*2 and 32*c*1 can move within the hollow 22*h* (FIG. 2) between corner pieces 20, when modules 30*b* and 30*c* are brought into proximity, the magnet stacks 32*b*2 and 32*c*1 can establish mutual attraction by one of the magnet stacks, e.g., 32*c*1 shifting relative to 32*b*2 to a position where dissimilar poles of the magnets 34, 38 in the respective stacks align. Because the magnet stacks, e.g., 32*b*2 and 32*c*1 can both move along a range of motion of Mt=M1+M2, and because there are a plurality of positions where the dissimilar poles may align (attributable to the plurality of magnets 34, 38 with spacers therebetween) the modules 30*b*, 30*c* may assume a variety of magnetically coupled positions, a subset of which are shown in dotted lines labeled P5, P6 and P7.

Figure 5:
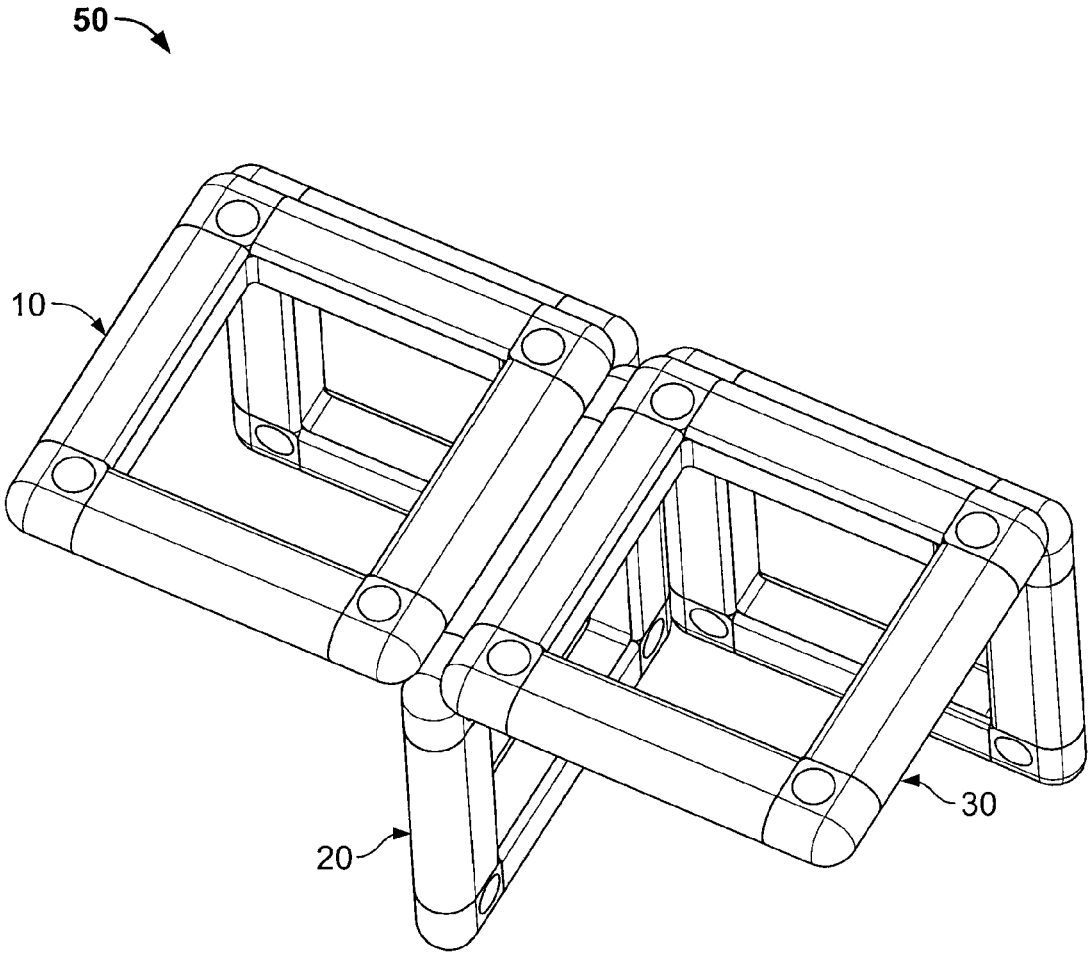
FIG. 5 is a perspective view of a plurality of modules in accordance with an embodiment of the present disclosure assembled into a three-dimensional structure.

FIG. 5 shows a three-dimensional structure 50 formed by connecting a plurality of modules 10, 20, 30 via their magnetic attraction to one another. The modules 10, 20, 30 may be of the same type, e.g., all modules like those shown in FIG. 3 or FIG. 4, or may be of mixed types. As noted above, the slideable magnets, 24 or magnet stacks 32 within the modules may be utilized to assemble modules 10, 20, 30 at a variety of positional offsets to produce different types of structures 50.

It will be understood that the embodiments described herein are merely exemplary and that a person skilled in the art may make many variations and modifications without departing from the spirit and scope of the claimed subject matter. For example, while the magnets 24 are described above in one embodiment as having a complementary shape to the caps 22, which prevents rotation of the magnets 24 relative to the caps 22, alternative means for preventing rotation could be employed, such as a sleeve with one or more external ribs into which the magnet 24 is inserted and/or to which the magnet 24 is fastened, e.g., by gluing. All such variations and modifications are intended to be included within the scope of the present disclosure.

What is claimed is:

1. A toy construction kit having a plurality of magnetic modules, each of which includes a housing having a plurality of sides, each of said plurality of sides having an internal hollow, and a magnet contained within said hollow at a given polar orientation relative to said housing and said hollow, said hollow having dimensions that permit said magnet to move within said hollow while substantially constraining said magnet to said given polar orientation relative to said housing.

2. The toy construction kit of claim 1, wherein the magnet is elongated in one dimension defining a longitudinal dimension and has a non-circular cross-sectional shape perpendicular to the longitudinal direction.

3. The toy construction kit of claim 2, wherein the non-circular cross-sectional shape is at least one of triangular, rectangular, square, hexagonal or trapezoidal.

4. The toy construction kit of claim 2, wherein the hollow has a cross-sectional shape mating with the cross-sectional shape of the magnet, preventing the magnet from rotating on a longitudinal axis.

5. The toy construction kit of claim 1, wherein the hollow is elongated, defining a longitudinal dimension and the hollow permits the magnet to be displaced in the hollow longitudinally.

6. The toy construction kit of claim 2, wherein the hollow is dimensioned to substantially prevent the magnet from rotating about an axis of rotation along the longitudinal dimension of the magnet, but permits the magnet to slide in a longitudinal direction within the hollow.

7. The toy construction kit of claim 6, wherein the longitudinal dimension of the hollow approximates twice a longitudinal dimension of the magnet.

8. The toy construction kit of claim 1, wherein the magnet includes a plurality of magnets.

9. The toy construction kit of claim 8, wherein the plurality of magnets are separated by at least one non-magnetic spacer.

10. The toy construction kit of claim 1, wherein the housing includes at least two sub-portions, capable of being assembled to define the hollow containing the magnet.

11. The toy construction kit of claim 1, wherein at least two of the plurality of magnetic modules may be magnetically held to one another at a plurality of relative positional offsets.

12. The toy construction kit of claim 11, wherein the plurality of positional offsets are offset in a direction parallel to the longitudinal direction of at least one of the internal hollows.

13. The toy construction kit of claim 12, wherein the dimensional range of positional offsets is limited by the dimensions of the internal hollows within the housings of the magnetic modules held together and the longitudinal dimensions of the magnets contained therein.

* * * * *